US005415226A

United States Patent [19]

Koo

[11] Patent Number: 5,415,226

[45] Date of Patent: May 16, 1995

[54] DEVICE FOR PREVENTING NOISE IN AIR CONDITIONER

[75] Inventor: Hyeong M. Koo, Anyang, Rep. of Korea

[73] Assignee: Samsung Electronics Co., Ltd., Kyungki, Rep. of Korea

[21] Appl. No.: 64,911

[22] Filed: May 24, 1993

[30] Foreign Application Priority Data

May 22, 1992 [KR] Rep. of Korea ..... 1992-8684

[51] Int. Cl.[6] ..... F01N 7/00

[52] U.S. Cl. ..... 165/135; 415/52.1; 415/119; 416/178; 416/187

[58] Field of Search ..... 165/135, 1, 2; 62/296; 415/52.1, 55.1, 119; 416/178, 187

[56] References Cited

U.S. PATENT DOCUMENTS

| | | | |
|---|---|---|---|
| 2,117,310 | 5/1938 | Garrott | 415/52.1 |
| 2,244,398 | 6/1941 | Knowlton | 415/52.1 |
| 2,423,634 | 7/1947 | Berliner | 415/52.1 |
| 3,684,396 | 8/1972 | Ball | 415/52.1 |
| 4,573,869 | 3/1986 | Kitamoto | 415/119 |
| 5,085,057 | 2/1992 | Thompson | 165/135 |
| 5,094,586 | 3/1992 | Takada | 415/119 |
| 5,120,193 | 6/1992 | Kadle | 415/119 |
| 5,165,855 | 11/1992 | Ricketts | 416/178 |
| 5,299,634 | 4/1994 | Toyoda | 165/135 |

*Primary Examiner*—Ira S. Lazarus
*Assistant Examiner*—Daniel J. O'Connor
*Attorney, Agent, or Firm*—Sughrue, Mion, Zinn, Macpeak & Seas

[57] ABSTRACT

A device for preventing noise in an air conditioner including a stabilizer with different inclination angles correspondingly with the different segments of the lateral blowing fan, so that the blades of the segments of the lateral blowing fan pass the stabilizer not simultaneously but sequentially, thereby reducing noise of the revolving blades to a great degree. The device can be applied not only to separate type air conditioners but also to all types of blowing devices using lateral blowing fan and cirrocofan.

4 Claims, 5 Drawing Sheets 12
12a
15
A
A

DEVICE FOR PREVENTING NOISE IN AIR CONDITIONER

FIELD OF THE INVENTION

The present invention relates to a device for preventing noise in a separate type air conditioner in which the noise produced from the indoor unit thereof is effectively prevented, and particularly to a device for preventing noise in an air conditioner in which the portions of a stabilizer corresponding to the respective segments of a lateral blowing fan are designed to have different phases by taking into account the number of blades and the number of segments, thereby effectively reducing the noise produced by the revolving blades of the fan. The present disclosure is based on the disclosure of Korean Patent Application No. 92-8684 filed May 22, 1992 which disclosure is incorporated herein by reference.

BACKGROUND OF THE INVENTION

Generally, a separate type air conditioner is installed in such a manner that a compressor, a condenser and an expansion valve are installed outdoors, and an evaporator is installed indoors, so that these elements form a freezing cycle.

The reason that the compressor, the condenser and the expansion valve are installed outdoors is that noise and heat are produced during the compression of the heat-exchanged refrigerant by driving the compressor, and that the heat which is absorbed and generated from the compressor has to be released.

Meanwhile, the reason for installing the evaporator indoors is that the heat within the room has to be absorbed, and an air conditioning has to be realized.

The compressor and the condenser of the separate type air conditioner, which are installed outdoors, are called outdoor units, and the evaporator which is installed indoors is called an indoor unit.

As shown in FIG. 1, the indoor unit of a separate type air conditioner includes: a heat exchanger 11 installed on the front portion of the interior of a case body 10; and a lateral blowing fan 12 consisting of a plurality of segments, and installed on the lower portion of the rear portion of the case body 10.

Further, an air inlet 13 for introducing the air is formed on the front face of the case body 10, and an outlet 14 is formed on the 2Lower face of the case body 10, while, between the lateral blowing fan 12 and the outlet 14, there is installed a stabilizer 15 the outlet 14, there is installed a stabilizer 15 disposed a certain distance from the lateral blowing fan 12.

As shown in FIG. 2 in detail, the lateral blowing fan 12 includes a plurality of segments, and each of the segments is provided with a plurality of blades 12*a*.

Further, in the lateral blowing fan 12, the plurality of blades 12*a* of each of the segments are uniform in their angles and intervals, but the blades of the different segments are arranged in different angles.

The blades 12*a* of odd numbered segments (I segments) are all disposed on the same horizontal plane, and the blades 12*a* of the numbered segments (II segments) are all disposed on the same horizontal plane, while the blades of odd numbered segments and even numbers segments are not disposed on the same horizontal plane.

The stabilizer 15 is installed at a side of the lateral blowing fan 12 with a predetermined distance and in parallel with the shaft of the internal blowing fan 12. The indoor unit of the conventional air conditioner constituted as described above operates in the following manner. When the lateral blowing fan 12 revolves, the external air is introduced through the The air sucked in this way passes through an evaporator 11 so as to be subjected to a heat exchange, and after the heat exchange, the air is discharged through an outlet 14 to the outside.

During the revolution of the lateral blowing fan, the blades 12*a* of odd numbered segment pass the stabilizer 15, and the blades 12*a* of even numbered segments follow the blades 12*a* of the odd numbered segments, this being continuously repeated.

However, in the indoor unit of the conventional air conditioner, when the blades 12*a* of the lateral blowing fan 12 pass the stabilizer 15, the plurality of the blades 12*a* pass simultaneously. Therefore, when the air passes through between the stabilizer and the lateral blowing fan 12 by the action of the lateral blowing fan 12, the frictional resistance of the air is increased due to various factors such as the gap between the lateral blowing fan 12 and the stabilizer 15, the angle of the stabilizer 15 and the like, with the result that noise is generated during the operation of the air condition.

SUMMARY OF THE INVENTION

The present invention is intended to overcome the above described disadvantages of the conventional techniques.

Therefore, it is an object of the present invention to provide a device for preventing noise in an air conditioner, in which there is provided a lateral blowing fan having a plurality of segments, with the blades of the adjacent segments being mutually differently arranged, and there is also provided a stabilizer having a varying feature corresponding with the differently arranged blades, so that the blades of the lateral blowing fan pass the stabilizer not simultaneously but sequentially, thereby reducing the blade noise during the revolutions of the blades.

In order to achieve the above object, the device for preventing the noise in an air conditioner according to the present invention includes: a lateral blowing fan having a plurality of segments, each of the segments having a plurality of blades, and the blades of the adjacent segments being differently arranged; and a stabilizer installed at a side of the lateral fan with a predetermined distance from the lateral blowing fan.

The device according to the present invention is characterized in that the stabilizer is provided with differently inclined sections in correspondence with the differently arranged blades, so that the blades pass the stabilizer not simultaneously but sequentially, thereby reducing noise during the revolution of the blades.

BRIEF DESCRIPTION OF THE DRAWINGS

The above object and other advantages of the present invention will become more apparent by describing in detail the preferred embodiment of the present invention with reference to the attached drawings in which:

FIGS. 3A–3C illustrate a stabilizer and a lateral blowing fan as the principal components of the noise preventing device of the present invention in which: FIG. 3A is a perspective view; FIG. 3B is a plan view of the stabilizer; and FIG. 3C is a sectional view taken along the line A—A of FIG. 3B.

DESCRIPTION OF THE PREFERRED EMBODIMENT

Figures 3A, 3B, 3C:
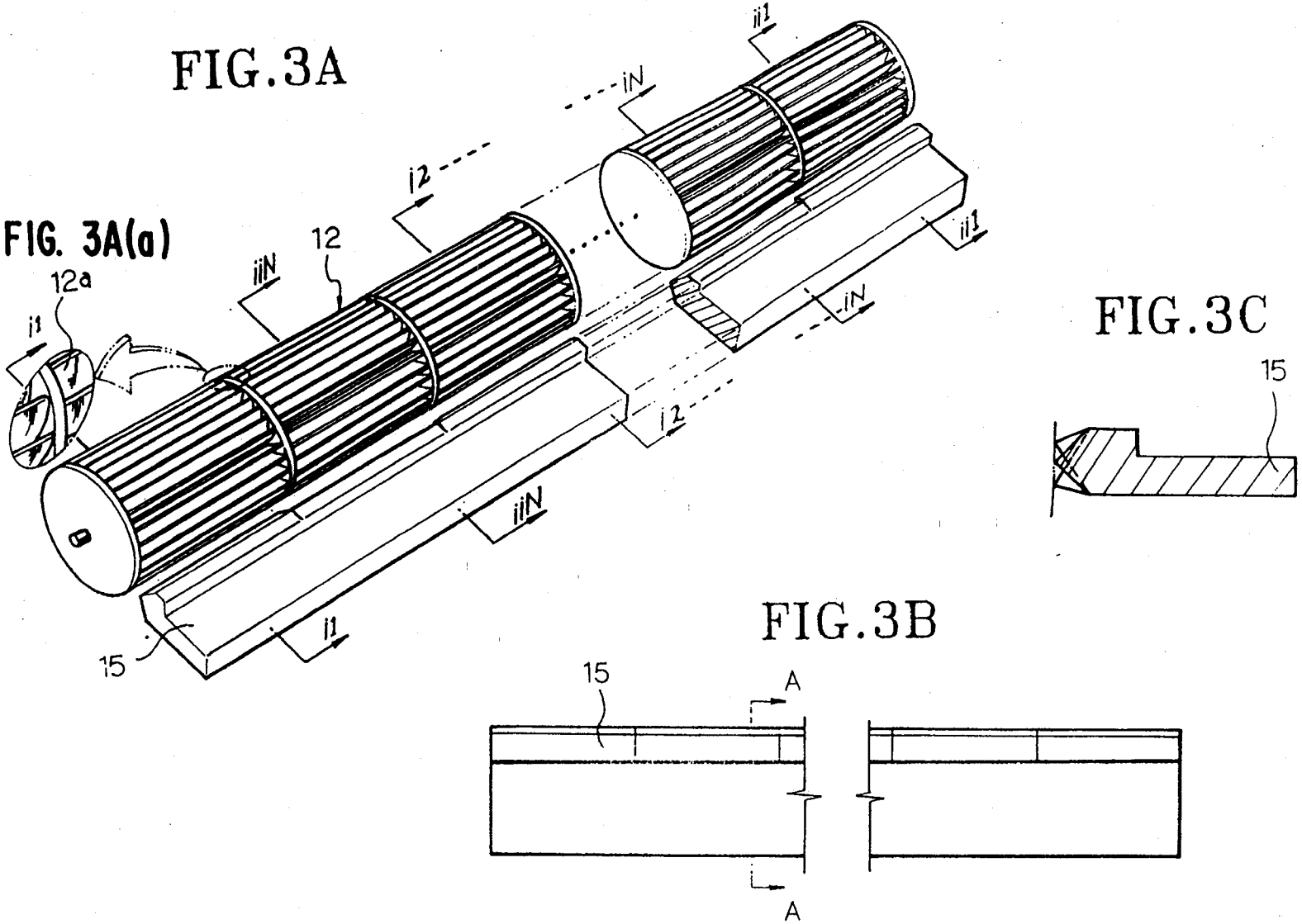
Figure 4A:
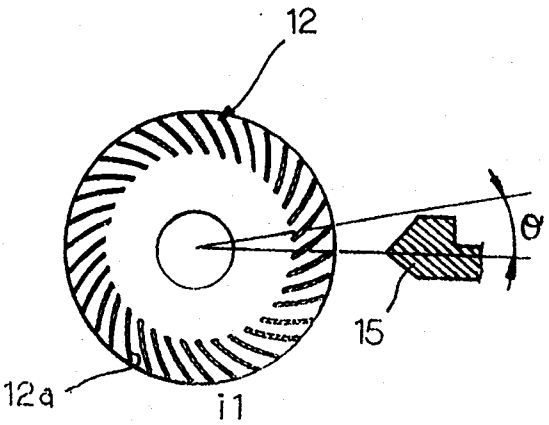
FIGS. 4A–4H are cross sectional views of the respective segments of the lateral blowing fan.
Figure 4B:
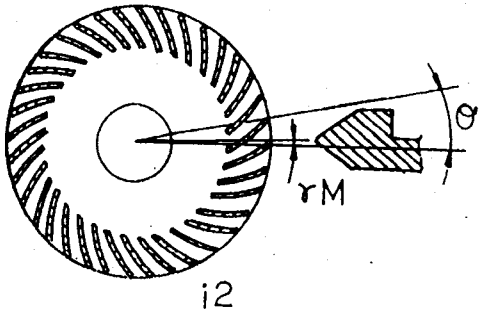
Figure 4C:
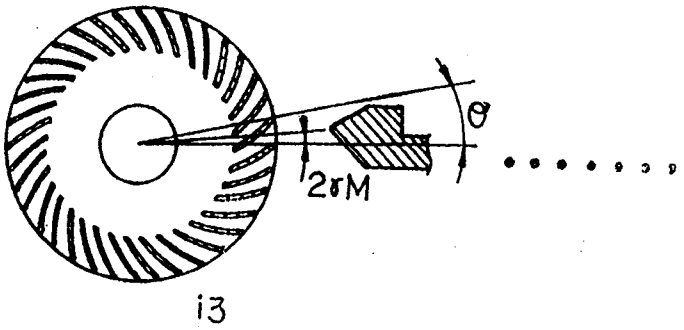
Figure 4D:
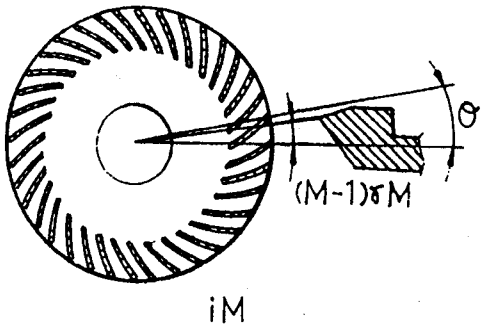
Figure 4E:
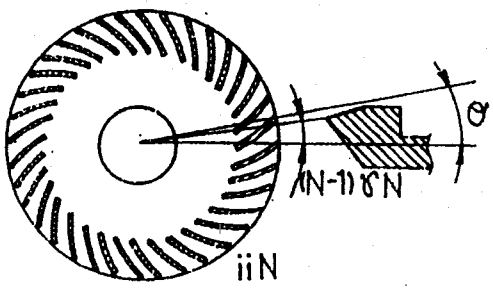
Figure 4F:
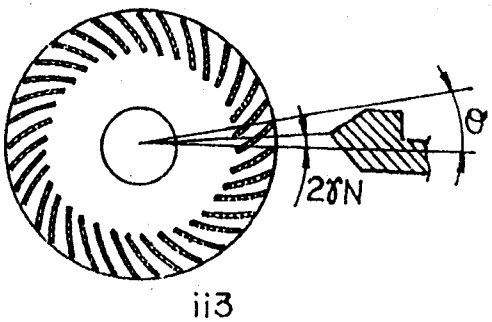
Figure 4G:
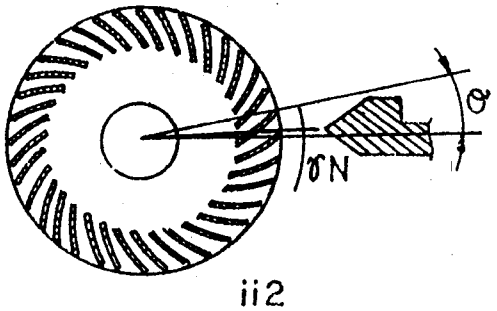
Figure 4H:
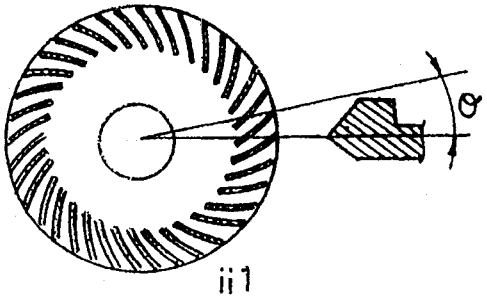

FIGS. 3 and 4 illustrate a device for preventing noise in an air conditioner according to the present invention.

Figure 1:
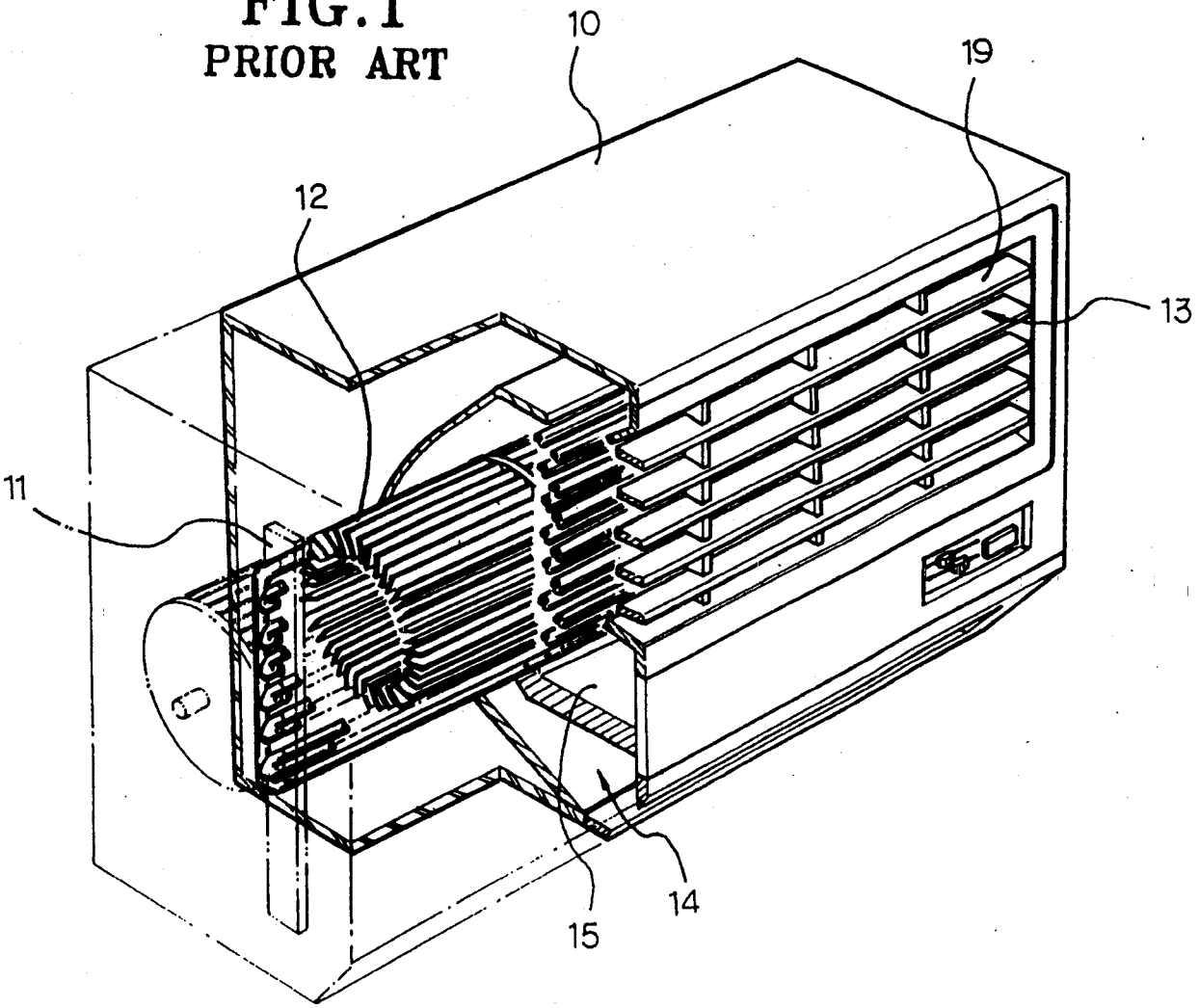
FIG. 1 PRIOR ART
FIG. 1 is a partly cut-out perspective view of the indoor unit of a known separate type air conditioner.
Figures 2, 2A:
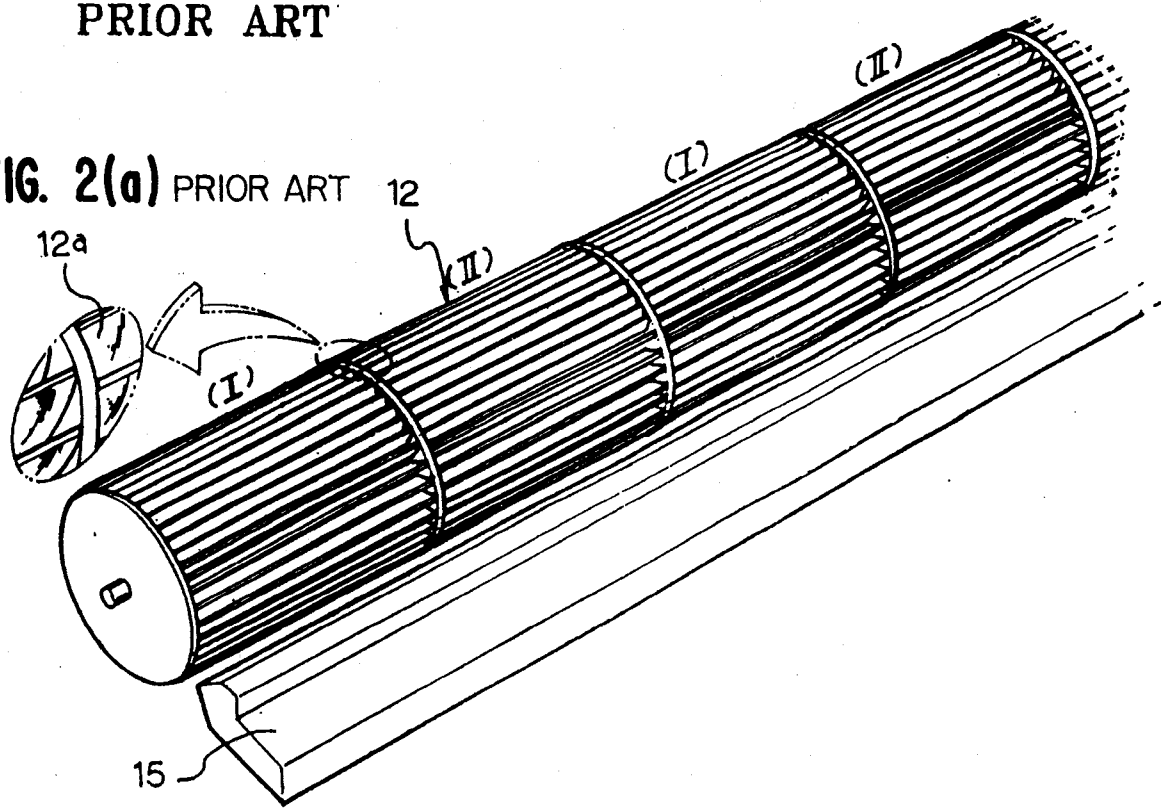
FIG. 2(a) PRIOR ART
FIG. 2 PRIOR ART
FIG. 2 is a perspective view of a conventional stabilizer and lateral blowing fan.

A case body 10 which is provided with an inlet 13 and an outlet 14 contains an evaporator 11 (e.g., as shown in FIGS. 1 and 2), a lateral blowing fan 12 and a stabilizer 15 (FIG. 3). The air which has undergone heat exchanges in the evaporator 11 is discharged to the outside, thereby forming a separate type air conditioner. The lateral blowing fan 12 is constituted the same as that of the conventional one with a plurality of segments, and each of the segments includes a plurality of blades 12*a* arranged at a predetermined angle, while the blades 12*a* of the adjacent segments are differently arranged.

The stabilizer 15 which is installed a predetermined distance from the lateral blowing fan 12 is provided with differently inclined portions correspondingly with the differently arranged segments, so that the blades 12*a* of the different segments of the lateral blowing fan 12 pass the stabilizer 15 not simultaneously but sequentially.

That is, the facing position of the blades 12*a* of the lateral blowing fan 12 with the stabilizer 15 as shown in FIGS. 4A to 4H can be defined by the following formulas.

$$\theta = \frac{360°}{\alpha n} \quad (1)$$

$$\gamma M = \frac{\theta}{M} \quad (2)$$

$$\gamma N = \frac{\theta}{N} \quad (3)$$

where $\theta$ represents the circumferential pitch angle, i.e., the angle between the blades;

n is the number of blades of the lateral blowing fan;

M is the number of the I segments;

N is the number of the II segments;

$\gamma$M is the inclination angle of the stabilizer corresponding to the I segments; and $\gamma$N is the inclination angle of the stabilizer corresponding to the II segments. The circumferential pitch angle $\theta$ is satisfactory with 9°~14° and it should be preferably 10°. If the pitch angle $\theta$ is over 15°, then not only will the preparation of the die become difficult, but it will also not be proper for the stabilizer 15. As shown in FIGS. 4A to 4H, the noise preventing device according to the present invention decides the angles of the stabilizer 15 as against the segments of the lateral blowing fan 12 based on the formulas (1), (2) and (3). Consequently, when the blades 12*a* of the segments of the lateral blowing fan 12 pass the stabilizer 15, the blades 12*a* of any segment do not pass the stabilizer simultaneously, but pass sequentially.

Therefore, the blade revolution noise which is generated because of the simultaneous pass of the blades is reduced to a great degree.

However, in Formula (1), the constant e should be provided with a proper value so that the circumferential pitch angle $\theta$ should not be increased too much, and that it should not give too much influence to the air flow rate and the performance of the lateral blowing fan 12. FIGS. 4A to 4H illustrate the case in which $\alpha=1$ (circumferential pitch angle=stabilizer inclination angle).

According to the present invention as described above, the stabilizer is provided with different inclination portions correspondingly with the different segments of the lateral blowing fan, so that a plurality of the blades do not pass the stabilizer simultaneously, but rather the blades pass the stabilizer sequentially. Consequently, the revolving blade noise is decreased to a great degree, thereby obtaining an air conditioning in a calm and quiet manner.

Further, the device of the present invention can be applied not only to the separate type air conditioner but also to all types of blowing devices using the lateral blowing fan or a cirrocofan. This feature shall come within the scope of the present invention.

What is claimed is:

1. A device for preventing noise in an indoor unit of a separate type air conditioner, comprising:

a lateral blowing fan having a plurality of segments, each of said segments having a plurality of blades, and the blades of adjacent segments being differently arranged from each other; and a stabilizer installed from said lateral blowing fan, said stabilizer having different inclination portions correspondingly with the different segments of said lateral blowing fan, so that said blades of the segments of said lateral blowing fan pass said stabilizer sequentially and not simultaneously, thereby reducing noise of revolving blades.

2. The device for preventing noise as claimed in claim 1, wherein an inclination angle of said stabilizer is determined by the following formulas:

$$\theta = \frac{360°}{\alpha n} \quad (1)$$

$$\gamma M = \frac{\theta}{M} \quad (2)$$

$$\gamma N = \frac{\theta}{N} \quad (3)$$

where $\theta$ represents the circumferential pitch angle, i.e., the angle between the blades;

n is the number of the blades of the lateral blowing fan;

M is the number of the I segments;

N is the number of the II segments;

$\gamma$M is the inclination angle of the stabilizer corresponding to the I segments.; and $\gamma$N is the inclination angle of the stabilizer corresponding to the II segments.

3. A method for preventing noise in an indoor unit of a separate type air conditioner having a lateral blowing fan with a plurality of segments, each of the segments having a plurality of blades, and the blades of adjacent segments being differently arranged from each other, the method comprising the steps of:

installing a stabilizer from said lateral blowing fan; and providing the stabilizer with different inclination portions correspondingly with the different segments of the lateral blowing fan so that the blades of the segments of the lateral blowing fan pass the stabilizer sequentially and not simultaneously, thereby reducing noise of revolving blades.

4. The method for preventing noise as claimed in claim 3, wherein an inclination angle of said stabilizer is determined by the following formulas:

$$\theta = \frac{360°}{\alpha n} \quad (1)$$

$$\gamma M = \frac{\theta}{M} \quad (2)$$

-continued $$\gamma N = \frac{\theta}{N} \quad (3)$$

where $\theta$ represents the circumferential pitch angle, i.e., the angle between the blades;

n is the number of the blades of the lateral blowing fan;

M is the number of the I segments;

N is the number of the II segments;

$\gamma$M is the inclination angle of the stabilizer corresponding to the I segments; and $\gamma$N is the inclination angle of the stabilizer corresponding to the II segments.

* * * * *